US006750390B2

(12) United States Patent
Ueta et al.

(10) Patent No.: US 6,750,390 B2
(45) Date of Patent: Jun. 15, 2004

(54) AUTOMATIC PERFORMING APPARATUS AND ELECTRONIC INSTRUMENT

(75) Inventors: Noriyuki Ueta, Hamamatsu (JP); Hideyuki Tanaka, Hamamatsu (JP); Akira Kawai, Hamamatsu (JP)

(73) Assignee: Kabushiki Kaisha Kawai Gakki Seisakusho, Hamamatsu (JP)

( * ) Notice: Subject to any disclaimer, the term of this patent is extended or adjusted under 35 U.S.C. 154(b) by 0 days.

(21) Appl. No.: 10/179,734

(22) Filed: Jun. 24, 2002

(65) Prior Publication Data

US 2003/0004701 A1 Jan. 2, 2003

(30) Foreign Application Priority Data

Jun. 29, 2001 (JP) ..... 2001-198879

(51) Int. Cl.[7] ..... G10H 7/00

(52) U.S. Cl. ..... 84/636; 84/612; 84/626; 84/652; 84/658

(58) Field of Search ..... 84/600–606, 609–613, 84/634–637, 649–652, 666–669, 626, 658

(56) References Cited

U.S. PATENT DOCUMENTS 4,402,244 A * 9/1983 Nakada et al. ..... 84/612
4,567,804 A * 2/1986 Sawase et al. ..... 84/115
4,903,565 A * 2/1990 Abe ..... 84/611
5,270,477 A * 12/1993 Kawashima ..... 84/622
5,866,833 A * 2/1999 Wakuda et al. ..... 84/609
6,124,543 A * 9/2000 Aoki ..... 84/609
6,452,082 B1 * 9/2002 Suzuki et al. ..... 84/609

* cited by examiner

*Primary Examiner*—Marlon T. Fletcher
(74) *Attorney, Agent, or Firm*—Davis & Bujold, PLLC

(57) ABSTRACT

An automatic performing apparatus and an electronic instrument with which a user can carry out an automatic musical performance, even for a complicated arrangement, simply by providing external events at certain intervals or corresponding only to a melody. In such an electronic instrument, at the time of execution of the automatic musical performance, the keyboard events are provided at intervals of one beat. Then, the automatic musical performance is progressed within a certain section corresponding to each of the provided keyboard events. Otherwise, at the time of execution of the automatic musical performance, the keyboard events are provided at the timing of a melody. Then, musical tones for the corresponding melody are generated, while those for accompaniments following the melody are also automatically generated. Furthermore, the tempo of the automatic musical performance is set on the basis of intervals between the keyboard events.

11 Claims, 14 Drawing Sheets

AUTOMATIC PERFORMING APPARATUS AND ELECTRONIC INSTRUMENT

FIELD OF THE INVENTION

The present invention relates to an automatic performing apparatus and an electronic instrument capable of executing an automatic musical performance by generating musical tones in accordance with external events.

BACKGROUND OF THE INVENTION

Conventionally, an electronic instrument has been used which is capable of executing an automatic musical performance by sequentially reading out song data, which are previously stored in a memory, and generating musical tones in response to events from the outside (for example, the action of pressing on keys of a keyboard).

By using such an electronic instrument, an automatic musical performance can be carried out only by providing simple external events. Accordingly, anyone can enjoy playing this musical instrument without learning how to play it.

More particularly, such an electronic instrument can provide children with an opportunity to get familiar with music. Furthermore, the aged and the physically handicapped, who will often have difficulty in learning to play a musical instrument, are also able to enjoy playing a musical instrument by means of such an electronic instrument.

However, in conventional electronic instruments, only one musical tone (or sound) is generated in response to one external event. Therefore, in order to achieve an automatic musical performance, it is necessary for a user to provide external events for all pieces of note data (that is, data relating to generation of musical tones among the song data stored in the memory).

Consequently, it has been sometimes difficult for a user to carry out an automatic musical performance with such a conventional electronic instrument, especially in the case of a complicated arrangement, in which case it is difficult to properly provide external events.

Also, in the case of a song consisting of a melody and accompaniments, if external events are provided only at the timing of the melody, musical tones for the accompaniments are not generated since they do not accord with each other in timing, which has been another problem with the conventional electronic instrument.

SUMMARY OF THE INVENTION

The present invention was made to solve the aforementioned problems. More particularly, the object of the present invention is to provide an automatic performing apparatus and an electronic instrument with which a user can achieve an automatic musical performance without difficulty only by providing external events, for example, at certain intervals, or correspondingly only to a melody, even in the case of a complicated arrangement.

In order to attain this object, there is provided an automatic performing apparatus for executing an automatic musical performance based on song data in response to external events, wherein the song data are segmented into prescribed sections; at the time of execution of an automatic musical performance, each time an external event is provided, the automatic musical performance progresses within a section corresponding to the external event provided; and tempo of the automatic musical performance is set on the basis of intervals between the external events.

In this automatic performing apparatus, the song data are segmented into the prescribed sections, and at the time of execution of an automatic musical performance, the automatic musical performance is executed by the section in response to each external event.

Accordingly, it is not necessary for a user to provide the external events with respect to all pieces of note data, and instead, it is only necessary for him/her to provide an external event, for example, with respect to each section of the song data, which enables the user to carry out an automatic musical performance more easily.

Particularly, in the case of a section comprising two or more pieces of note data, musical tones can be automatically generated based on the two or more pieces of note data in response to only one external event. Accordingly, compared to cases where the external events need to be provided with respect to all pieces of note data, the number of provision of such external events can be reduced.

Also, in the automatic performing apparatus of the invention, the tempo of the automatic musical performance is set on the basis of intervals between the external events. In other words, when the external events are provided with a short interval, the automatic musical performance is executed at a fast tempo. On the contrary, when the external events are provided with a long interval, the automatic musical performance is executed at a slow tempo.

Consequently, the tempo of the automatic musical performance can be freely changed by varying the intervals between the external events.

Furthermore, due to such changes in the tempo of the automatic musical performance depending on the intervals between the external events, undesired situations, for example, in which the next external event is provided before completion of generation of musical tones based on all pieces of note data within a certain section or, on the contrary, in which there is an unnatural pause inserted between completion of generation of musical tones based on all pieces of note data within a certain section and provision of the next external event, are less likely to occur compared to cases where the automatic musical performance is progressed at a fixed tempo.

Here, the note data mean some information, for example, that is part of the song data and gives the automatic performing apparatus instructions to generate musical tones.

In the foregoing automatic performing apparatus, each of the prescribed sections may correspond to one beat of the song data.

In such an automatic performing apparatus, each section corresponding to each external event is equivalent to one beat of a song, and consequently, each time an external event is provided, the automatic musical performance is progressed by the beat.

Accordingly, by using such an automatic performing apparatus, a user can carry out an automatic musical performance only by providing external events at intervals of one beat, which is a very easy operation for the user.

Alternatively, in the foregoing automatic performing apparatus, each of the prescribed sections may comprise a piece of note data for a melody and note data for accompaniments following the piece of note data for the melody.

In such an automatic performing apparatus, each section corresponding to each external event includes a piece of note data for a melody and note data for accompaniments following the piece of note data for the melody, and consequently, each time an external event is provided, a melody part and accompaniment parts accompanying the melody part are both automatically performed.

Accordingly, a user can achieve an automatic musical performance by providing external events only at the timing of the note data for a melody, and it is thus unnecessary for the user to provide any external events with respect to the note data for accompaniments.

Such an automatic performing apparatus is thus easy to operate for the user.

In the foregoing automatic performing apparatus, the tempo of the automatic musical performance may be set by means of a ratio of an assumed value of the interval between the external events to an actual measurement thereof.

Here is also provided, by way of example, a method of setting the tempo.

According to this tempo setting method, for example, an assumed value (i.e., "tap clock") of an interval between the external events is compared with an actually measured value (i.e., "tap time") thereof. Then, if the actually measured interval is shorter, the tempo is set to be faster than the current tempo. On the contrary, if the actually measured interval is longer, the tempo is set to be slower than the current tempo.

More specifically, the tempo of the automatic musical performance (i.e., "new tempo") is reset, for example, by means of the following formula, each time an external event is provided:

$$(\text{New Tempo})=(\text{Old Tempo})\times(\text{Tap Clock})/(\text{Tap Time})$$

The "old tempo" may be a tempo determined and set by means of the above formula when the previous external event is provided. As to setting of a first tempo set immediately after the automatic musical performance is started, for example, a value previously recorded in the song data may be utilized as the first tempo.

In such an automatic performing apparatus, the tempo of the automatic musical performance is automatically reset in accordance with changes of the intervals between the external events, and consequently, it is possible for a user to freely change the tempo of the automatic musical performance by varying the intervals between the external events.

Also, due to such changes in the tempo of the automatic musical performance depending on the intervals between the external events, undesired situations, for example, in which the next external event is provided (in other words, the automatic musical performance within the next section is started) before completion of the automatic musical performance within a certain section or, on the contrary, in which there is an unnatural pause inserted between completion of the automatic musical performance within a certain section and provision of the next external event (in other words, start of the automatic musical performance within the next section) are less likely to occur, compared to cases where the automatic musical performance is progressed at a fixed tempo.

The aforementioned assumed value may be, for example, a value previously recorded in the song data as an assumed value of an interval between the external events. This assumed value may be the same for all of the intervals between the external events, or may be different depending on each external event (for example, depending on a first, second, . . . or nth external event in the automatic musical performance).

Alternatively, the aforementioned assumed value may be, for example, a difference between a step time (i.e., information included in each piece of note data, which represents timing for generating a musical tone based on each piece of note data) of note data corresponding to an external event and a step time of note data corresponding to the next external event.

The aforementioned actual measurement (or actually measured value) may be, for example, the clock number of a timer which operates at a prescribed tempo between provisions of two external events. The tempo of the timer may be, for example, the "old tempo" mentioned above.

Alternatively, in the foregoing automatic performing apparatus, the tempo of the automatic musical performance may be set by means of a tempo determined by the interval between the external events.

Here is also provided, by way of example, another setting method of the tempo.

According to this setting method, for example, a tempo "F" at which external events are provided is calculated on the basis of an interval between the external events, and the tempo of the automatic musical performance is set by means of the tempo "F".

For example, each time an external event is provided, the tempo of the automatic musical performance (i.e., "new tempo") is reset by means of the following formula:

$$(\text{New Tempo})=\alpha(\text{Old Tempo})+(1-\alpha)\ F$$

The "old tempo" is, for example, a tempo set by means of the above formula when the previous external event is provided. As to a first tempo set immediately after the automatic musical performance is started, for example, a value previously recorded in the song data may be utilized as the first tempo.

The above "$\alpha$" is a numerical value larger than zero and smaller than one, which may be, for example, 0.5. If the value of "$\alpha$" is larger, a contribution of "F" to the "new tempo" becomes smaller, thereby making a change of the "new tempo" gradual. On the contrary, if the value of "$\alpha$" is smaller, it is possible to immediately change the "new tempo" in accordance with the change of the interval between the external events.

In cases where the interval between the external events is, for example, 0.5 second, the above "F" is calculated as follows: $F=60/0.5=120$ (times per minute)

In such an automatic performing apparatus, the tempo of the automatic musical performance is automatically reset according to changes of the intervals between the external events, and consequently, a user can freely change the tempo of the automatic musical performance by varying the intervals between the external events.

Also, due to such changes in the tempo of the automatic musical performance depending on the intervals between the external events, undesired situations, for example, in which the next external event is provided (in other words, the automatic musical performance within the next section is started) before completion of the automatic musical performance within a certain section or, on the contrary, in which there is an unnatural pause inserted between completion of the automatic musical performance within a certain section and provision of the next external event (in other words, start of the automatic musical performance within the next section) are less likely to occur, compared to cases where the automatic musical performance is progressed at a fixed tempo.

In the foregoing automatic performing apparatus, the external events may include information on strength of tones to be generated.

In such an automatic performing apparatus, information on strength of tones to be generated (i.e., velocity information) is supplied by way of the external events, and consequently, for example, when an external event is provided, the volume of musical tones to be generated in the automatic musical performance is determined in accordance with such velocity information included in the provided external event.

More specifically, by way of example, the volume of musical tones to be generated in the automatic musical performance may be determined and set in the following manner.

Data on the volume of musical tones (i.e., velocity value) is recorded in each piece of note data, and the volume of musical tones to be generated based on each piece of note data is basically determined in accordance with this velocity value recorded therein at the time of execution of the automatic musical performance. If the velocity information included in an external event is larger than a prescribed value, the velocity value in each piece of note data within a section corresponding to that external event is corrected to be a value one point two (1.2) times the original velocity value. Then, musical tones are generated on the basis of the corrected velocity value.

On the contrary, if the velocity information included in an external event is smaller than a prescribed value, the velocity value in each piece of note data within a section corresponding to that external event is corrected to be a value zero point seven (0.7) times the original velocity value, and musical tones are then generated based on the corrected velocity value.

In such an automatic performing apparatus, the volume of musical tones can be controlled, for example, per section by means of the velocity information included in each external event.

The external events including the velocity information may be, for example, the action of pressing on keys of a keyboard, operation of a panel switch (i.e., panel SW) in an operation panel, or key-on information inputted as MIDI data. Otherwise, operational information on an analogue device, such as a bender, may be utilized as the external events.

The velocity information may be, for example, a parameter representing strength (or velocity) with which any key of the keyboard is pressed on when the external events are the action of pressing on keys of a keyboard. Also, when the external events are the operation of a panel switch (i.e. panel SW) in an operation panel, the velocity information may be a parameter representing strength (or velocity) with which the panel SW is pressed on.

In the foregoing automatic performing apparatus, the external events may mean operation of pressing on keys of a keyboard.

In such an automatic performing apparatus, the automatic musical performance can be executed in response to a user's action of pressing on any key of the keyboard to provide an external event.

In this case, the external events may be caused using all keys of the keyboard, or using particular keys only.

The automatic performing apparatus of the invention may, for example, be a keyboard instrument such as an electronic piano.

The keyboard may be a part of the automatic performing apparatus. Otherwise, it may be separated from the automatic performing apparatus and connected thereto by way of, for example, a MIDI terminal.

Alternatively, in the foregoing automatic performing apparatus, the external events may mean operation in an operation panel for operating the automatic performing apparatus.

In such an automatic performing apparatus, the automatic musical performance can be executed, for example, by operating a button provided in the operation panel, thereby causing an external event.

The operation panel may be a part of the automatic performing apparatus. Otherwise, it may be separated from the automatic performing apparatus and connected thereto by way of, for example, a MIDI terminal.

BRIEF DESCRIPTION OF THE DRAWINGS

The preferred embodiments of the present invention will now be described in detail with reference to the accompanying drawings, in which.

DESCRIPTION OF THE PREFERRED EMBODIMENTS

First Embodiment

Figure 1:
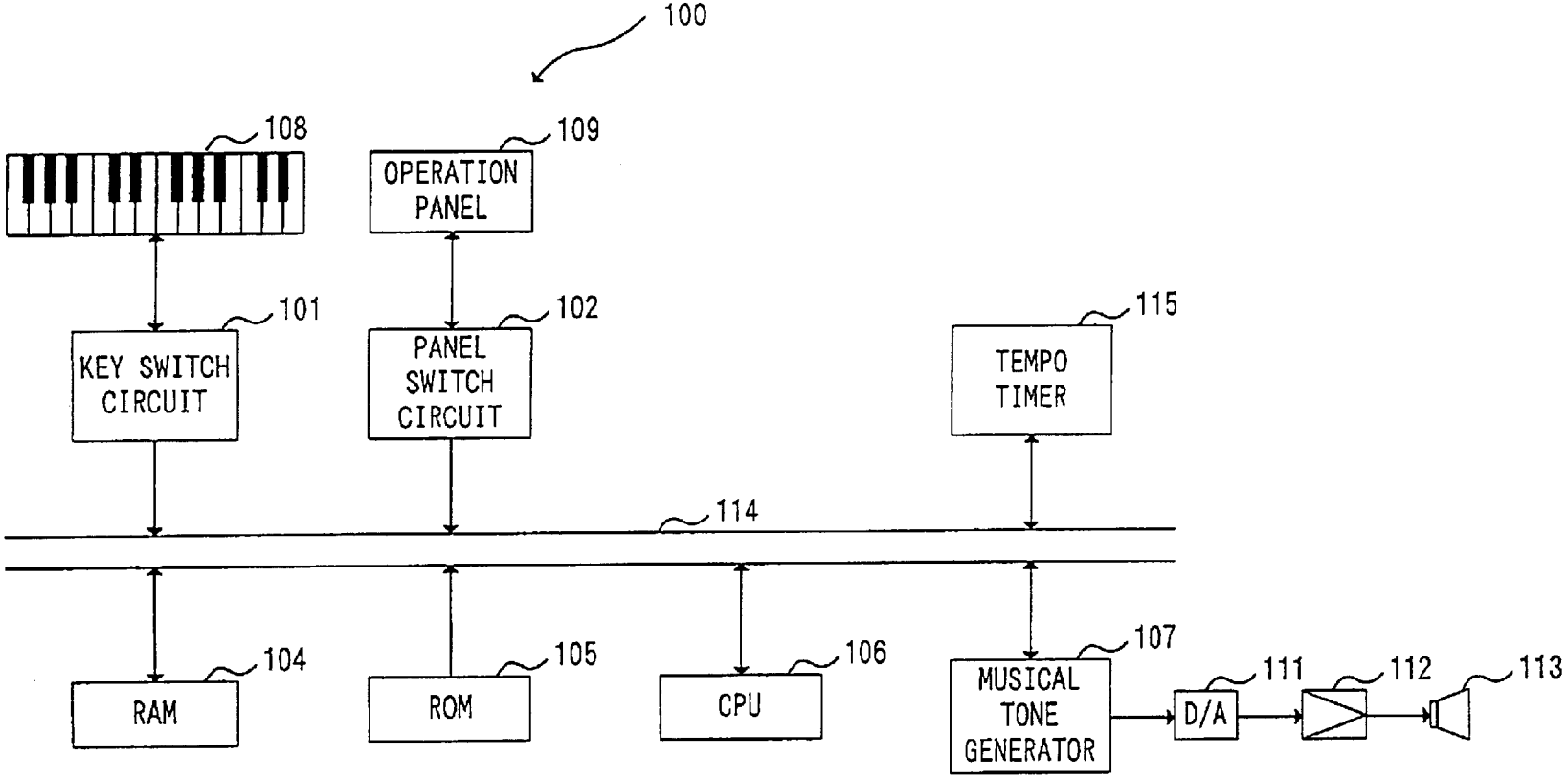
FIG. 1 is an explanatory view showing the entire composition of an electronic instrument according to a first embodiment of the invention.

As shown in FIG. 1, an electronic instrument (automatic performing apparatus) 100 comprises a keyboard 108, a key switch circuit 101 for detecting the operational state of the keyboard 108, an operation panel 109, a panel switch circuit 102 for detecting the operational state of the operation panel 109, a RAM 104, a ROM 105, a CPU 106, a tempo timer 115 and a musical tone generator (or musical tone generating circuit) 107, which are all coupled by means of a bus 114.

Also, a digital/analogue (D/A) converter 111, an amplifier 112 and a speaker 113 are serially connected to the musical tone generator 107.

The operation panel 109 comprises a mode selection switch. If a normal performance mode is selected in the mode selection switch, the electronic instrument 100 functions as a normal electronic instrument, and if an automatic performance mode is selected therein, the electronic instrument 100 functions as an automatic performing apparatus.

The operation panel 109 also has a song selection switch, by means of which a song to be automatically performed can be selected.

The operation panel 109 is further provided with an indicator 109*a* for indicating timing at which keyboard events (that is, the action of pressing on any key of the keyboard 108; also referred to as external events) are to be provided in execution of an automatic musical performance.

Figure 2A:
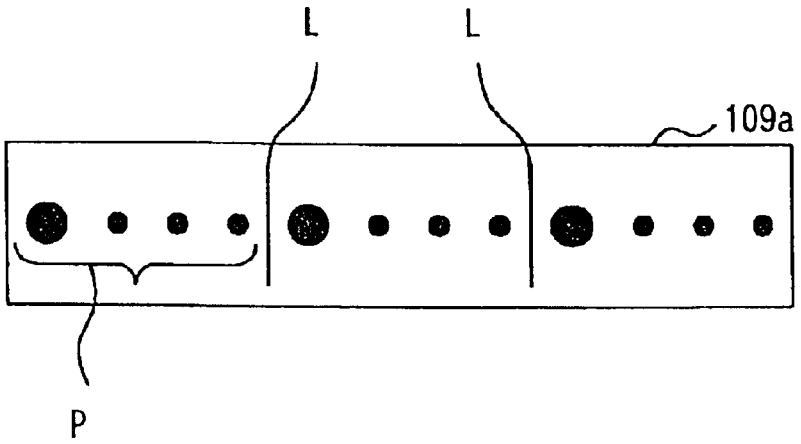
FIGS. 2A and 2B are explanatory views each showing an indicator in the electronic instrument according to the first embodiment.

More specifically, as shown in FIG. 2A, the indicator 109*a* indicates the timing at which the keyboard events should be provided in the automatic musical performance (large black circles) and the number of note data based on which musical tones are generated in response to each of the provided keyboard events (small black circles).

Figure 2B:
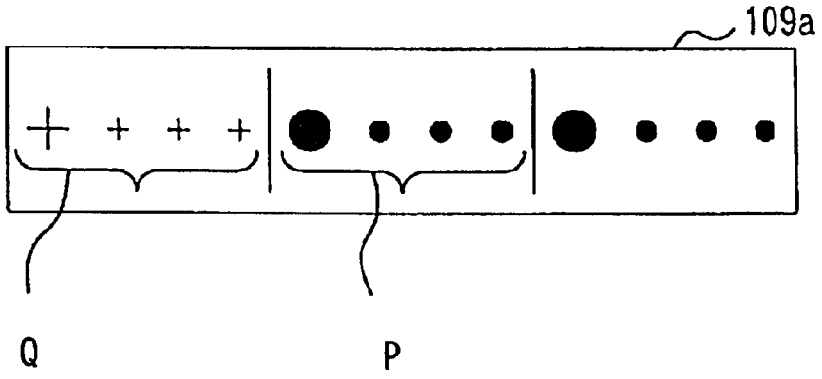

Furthermore, in the indicator 109*a*, segmentation into each section equivalent to one beat is also indicated. After musical tones have been generated based on some note data in response to some keyboard event, the corresponding large and small black circles are changed into cross marks, as shown in FIG. 2B. In FIGS. 2A and 2B, P indicates the timing for generation of musical tones, L indicates the segmentation into each section equivalent to one beat, and Q indicates accomplishment of generation of musical tones.

The tempo timer 115 supplies the CPU 106 with interrupting signals at certain intervals during execution of the automatic musical performance, and the tempo of the automatic musical performance is thus set on the basis of the tempo timer 115.

The ROM 105 stores a program for controlling the entirety of the electronic instrument 100 and various kinds of data. In addition, automatic performance data (i.e., song data) for a plurality of songs and a program for performance control functions are also stored in the ROM 105.

Figure 3:
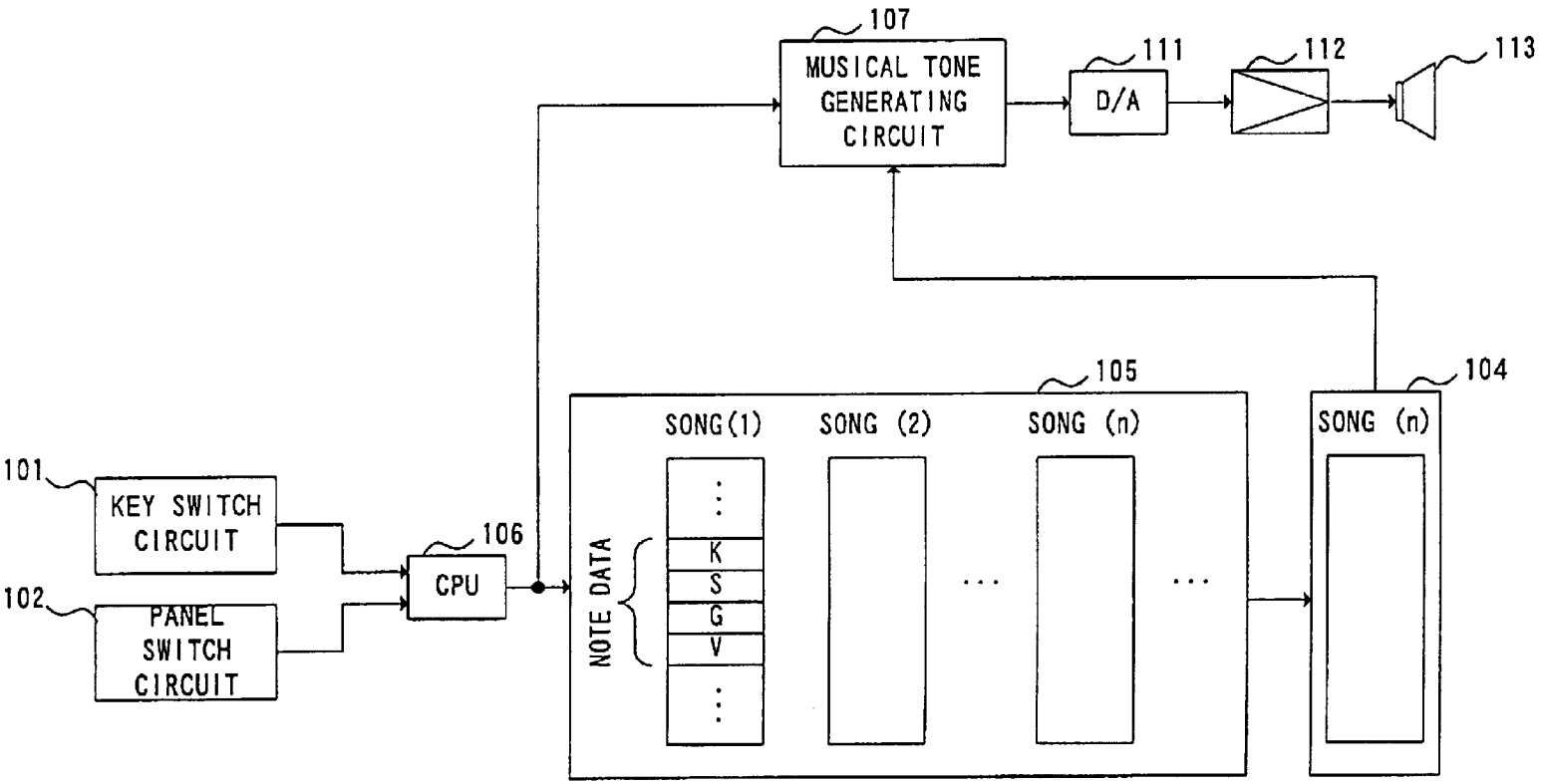
FIG. 3 is an explanatory view showing a ROM and peripheral parts thereof in the electronic instrument according to the first embodiment.

The automatic performance data are previously stored in the ROM 105 with respect to each song (song (1), song (2), . . . song (n)), as shown in FIG. 3.

Figure 4:
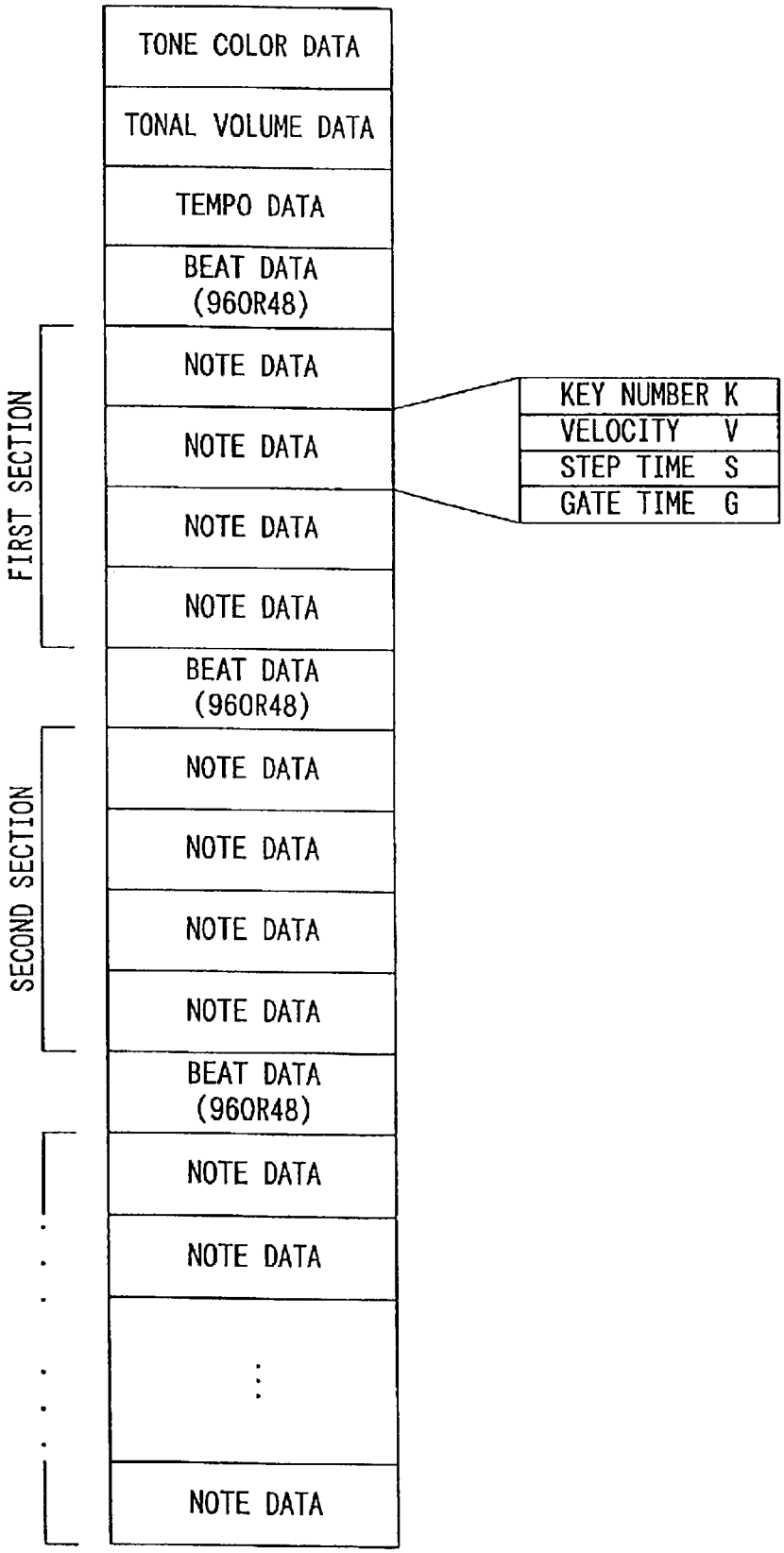
FIG. 4 is an explanatory view of automatic performance data in the electronic instrument according to the first embodiment.

As shown in FIG. 4, the automatic performance data on each song include tone color data, tonal volume data, tempo data and beat data at the beginning of each song. Also, the automatic performance data include several pieces of note data in each section (beat) equivalent to one beat of a song, and beat data correspondingly provided for each beat (section).

Figure 13:
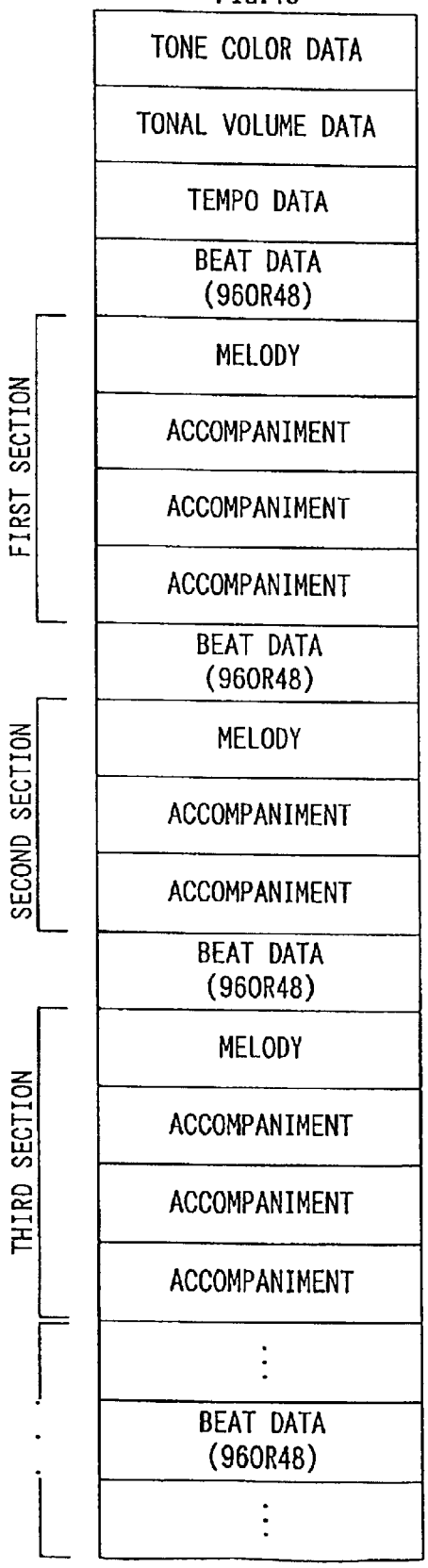
FIG. 13 is an explanatory view of automatic performance data in an electronic instrument according to a second embodiment of the invention.

The tone color data are data to designate the tone color of musical tones to be generated based on the following note data (or note data for a melody and those for accompaniments in FIG. 13).

The tonal volume data are data to control the tonal volume of the musical tones to be generated.

The tempo data are data to control the tempo or speed of the automatic musical performance only in a first beat (section) of the song. The tempo in a second and subsequent beats is determined based on the timing of provision of the keyboard events as described below.

The beat data have recorded therein a "tap clock" for a corresponding beat (section); more specifically, a value of 96 or 48. For example, if a beat (section) is in three-four time or four-four time, a value of 96 is recorded for that beat (section), and if a beat (section) is in six-eight time, a value of 48 is recorded for that beat (section).

The "tap clock" is an assumed value of the number of times (i.e., clock number) the signals are sent by the tempo timer 115 in the corresponding beat (section).

Each piece of note data includes key number K, step time S, gate time G, and velocity V.

Here, the step time S represents timing at which a musical tone is generated based on the corresponding piece of note data, regarding the beginning of the song as a base point.

The key number K represents a tone pitch. The gate time G represents the duration of generation of a musical tone. Then, the velocity V represents the volume of a musical tone to be generated (i.e., pressure at which a key is pressed).

The CPU 106 executes the automatic musical performance as described below by means of a program previously stored in the ROM 105.

Also, the CPU 106 performs operational control over the entire electronic instrument 100 by reading out and executing various control programs stored in the ROM 105. At this time, the RAM 104 is utilized as a memory for temporarily storing various kinds of data in order for the CPU 106 to execute various control processings.

At the time of execution of the automatic musical performance, as shown in FIG. 3, the RAM 104 retains the automatic performance data on a song to be automatically performed, and send the same to the musical tone generator 107 according to need.

The musical tone generator 107 generates musical tones on the basis of the prescribed automatic performance data sent from the RAM 104 at the time of execution of the automatic musical performance, while it generates musical tones in accordance with keys pressed on the keyboard 108 at the time of execution of a normal musical performance.

Now, the outline of the operation in the automatic performance mode of the electronic instrument 100 according to this embodiment will be described.

When the automatic performance mode is selected in the electronic instrument 100, upon provision of a first keyboard event, an automatic musical performance is progressed from the beginning of a first section to the end thereof on the basis of the automatic performance data. Subsequently, in response to a second keyboard event, the automatic musical performance is progressed from the beginning of a second section to the end thereof. Then, in the same manner, the automatic musical performance is progressed from the beginning of an nth section to the end thereof in response to an nth keyboard event.

In cases where an (n+1)th keyboard event is provided prior to completion of the automatic musical performance within the nth section, even if there are some note data left without being changed into musical tones, the remaining note data are disregarded and skipped such that the automatic musical performance is recommended from the beginning of an (n+1)th section. Also, after completion of the automatic musical performance within the nth section, progression of the automatic musical performance is suspended until the next (i.e., (n+1)th) keyboard event is provided.

The tempo of the automatic musical performance within the nth section executed by the electronic instrument 100 is synchronized with the tempo of the tempo timer 115. The latter is reset each time a keyboard event is provided (in other words, with respect to each section of the automatic performance data) by means of the following formula:

$$(\text{New Tempo})=(\text{Old Tempo})\times(\text{Tap Clock})/(\text{Tap Time})$$

In this formula, the "old tempo" means the tempo of the automatic musical performance in the previous section (i.e., (n−1)th section).

As to the tempo in the first section of the song, it is set on the basis of the tempo data included in the automatic performance data.

The "tap clock" is, as mentioned above, a value (96 or 48) previously recorded in the automatic performance data as an assumed value of the number of times (i.e., clock number) the signals are transmitted by the tempo timer 115 during each section.

The "tap time" is an actual measurement of the clock number of the tempo timer 115 between provisions of the previous keyboard event (i.e., (n−1)th keyboard event) and the current keyboard event (i.e., nth keyboard event).

Accordingly, when the "tap time" is smaller than the "tap clock," in other words, when an interval between two successive keyboard events is shorter than assumed, the "new tempo" is set to be faster than the "old tempo." On the contrary, in cases where the "tap time" is larger than the "tap clock," in other words, in cases where an interval between two successive keyboard events is longer than assumed, the "new tempo" is set to be slower than the "old tempo."

On the other hand, when the normal performance mode is selected, the electronic instrument 100 carries out the same functions as those of a normal electronic instrument, which functions do not directly relate to the subject matter of the invention and, therefore, no reference is made herein to such functions.

Now, the operation of the electronic instrument 100 according to this embodiment, particularly, in the automatic performance mode, will be specifically described.

Figure 5:
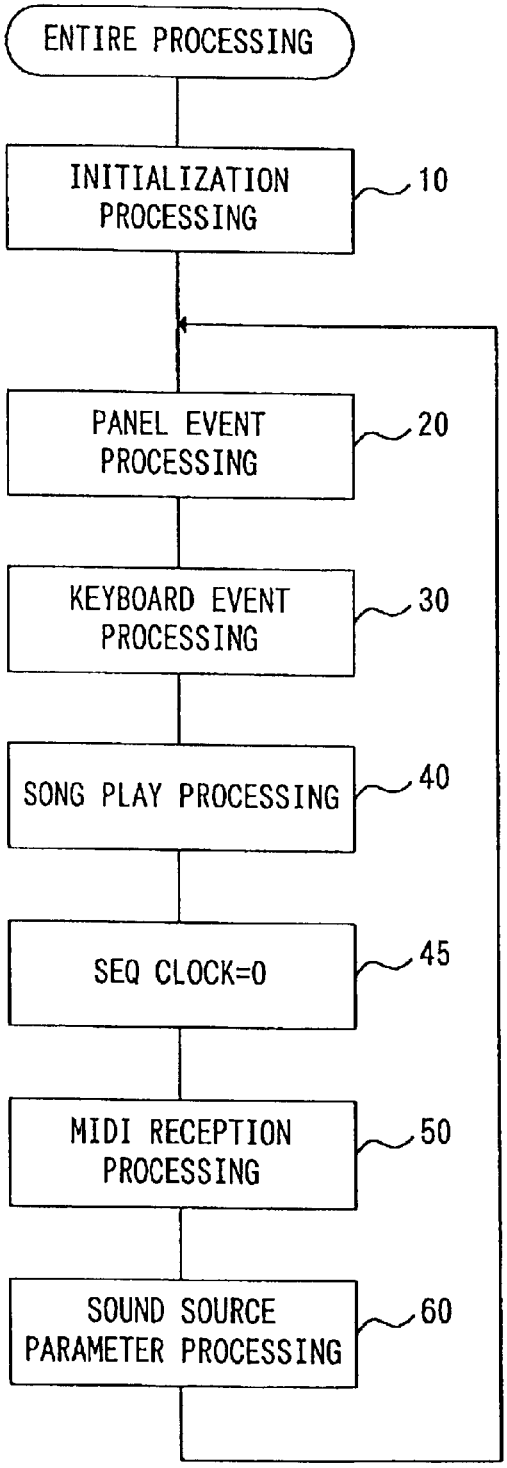
FIG. 5 is a flow chart showing the entire flow of processing executed in the electronic instrument according to the first embodiment.

Main routines of the entire processing executed in the electronic instrument 100 are shown in FIG. 5. Once the power is applied to the electronic instrument 100, initialization processing is first of all executed (step 10).

In the initialization processing, the internal state of the CPU 106 is reset into the initial condition, while a register, a counter, a flag and others defined in the RAM 104 are all initialized. In addition, in the initialization processing, the prescribed data are sent to the musical tone generator 107, and processing for preventing undesired sounds from being generated while the power is on is also carried out.

Once the initialization processing is ended, panel event processing is subsequently started (step 20).

Figure 6:
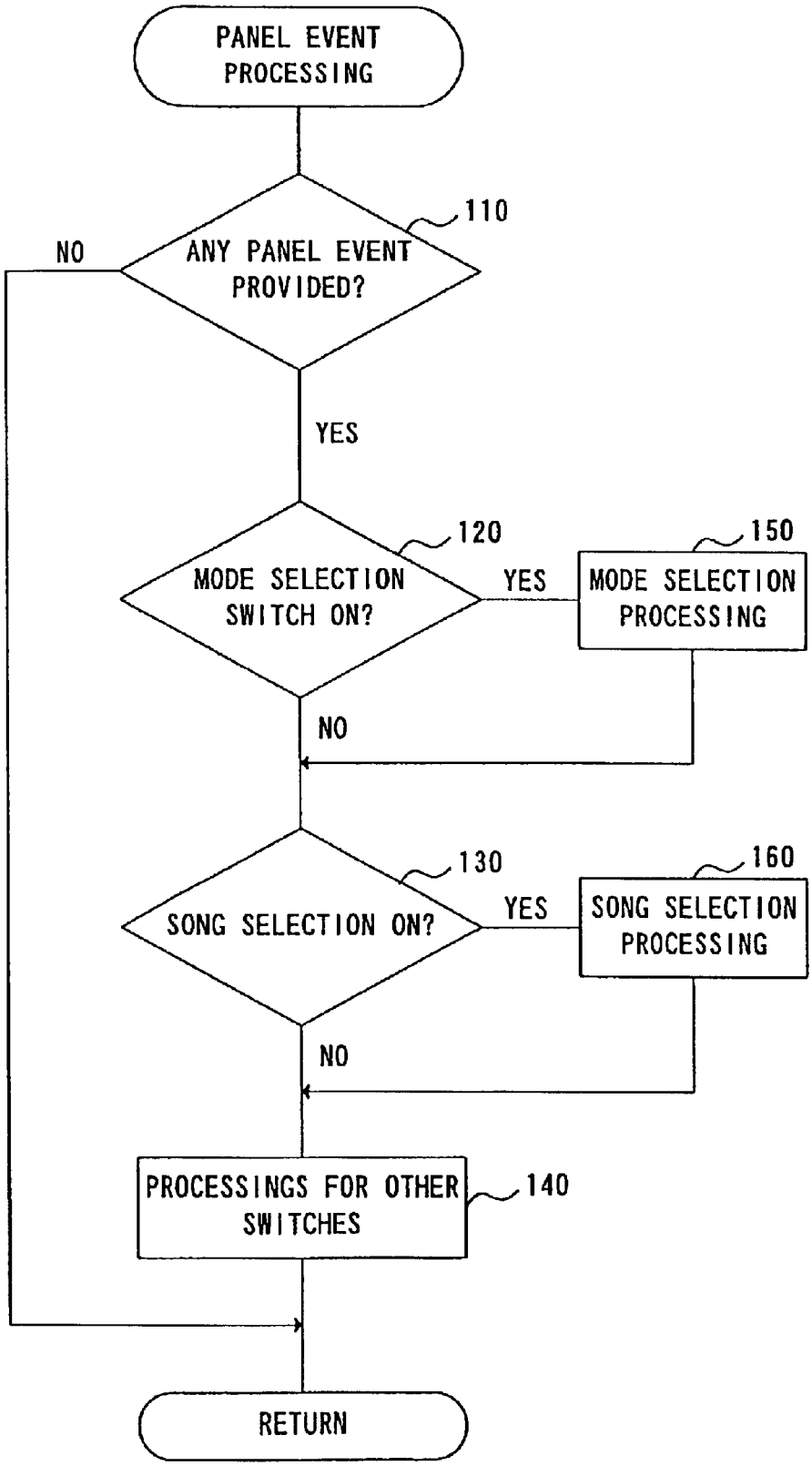
FIG. 6 is a flow chart showing panel event processing executed in the electronic instrument according to the first embodiment.

The details of the panel event processing are illustrated in FIG. 6. In this panel event processing, it is first determined whether or not any operation has been conducted in the operation panel 109 (step 110). This determination is achieved in the following manner. First of all, the panel switch circuit 102 scans the operation panel 109 to obtain data representing the on/off state of each switch (hereinafter referred to as new panel data), and the data are imported as a bit array corresponding to each switch.

Subsequently, data previously read in and already stored in the RAM 104 (hereinafter referred to as old panel data) are compared with the new panel data to create a panel event map in which different bits are turned on. The presence of any panel event is determined by referring to this panel event map. More specifically, if there is existing even only one bit that is on in the panel event map, it is determined that any panel event has been provided.

In cases where the presence of no panel event is determined at step 110, the processing returns from the panel event processing routines to the main routines.

On the other hand, in cases where the presence of any panel event is determined at step 110, the processing proceeds to the next step at which it is determined whether or not the panel event is an event of the mode selection switch (step 120). Such determination is made by checking whether or not a bit corresponding to the mode selection switch is on in the panel event map.

In cases where it is determined that the panel event is not the event of the mode selection switch, the processing proceeds to step 130, while in cases where it is determined that the panel event is the event of the mode selection switch, mode change processing is carried out (step 150). By this mode change processing, the mode is switched over between the normal performance mode and the automatic performance mode. After the mode change processing is ended, the processing proceeds to step 130.

At step 130, it is determined whether or not the panel event is an event of the song selection switch. Such determination is made by checking whether or not a bit corresponding to the song selection switch is on in the panel event map.

In cases where it is determined that the panel event is not the event of the song selection switch, the processing proceeds to step 140, while in cases where it is determined that the panel event is the event of the song selection switch, song selection processing is carried out (step 160). By this song selection processing, a song to be automatically performed is selected, and the song designated by the song selection switch is automatically performed at the time of execution of the automatic musical performance. After the song selection processing is ended, the processing proceeds to step 140.

At step 140, similar processings are respectively executed for other switches. More specifically, such "processings for other switches" include the processings of panel events of, for example, a tone color selection switch, acoustic effect selection switch, volume setting switch and others, which processings do not directly relate to the present invention and the description thereof is thus omitted here. After such "processings for other switches" are ended, the processing returns from the panel event processing routines to the main routines.

Figure 7:
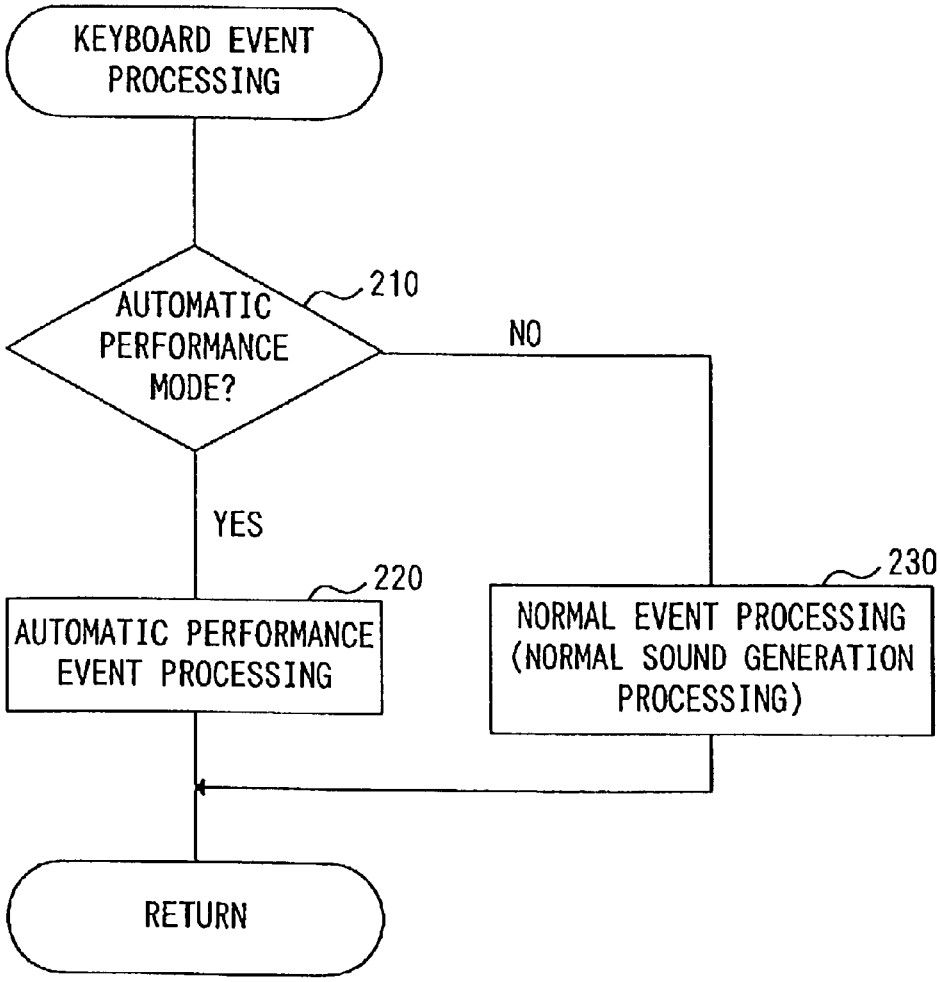
FIG. 7 is a flow chart showing keyboard event processing executed in the electronic instrument according to the first embodiment.

Once the panel event processing is ended, keyboard event processing (step 30 in FIG. 5) is then executed. The details of the keyboard event processing are shown in FIG. 7.

First of all, at step 210, it is determined whether or not the automatic performance mode is being selected. In the case of the automatic performance mode, the processing proceeds to step 220 to execute automatic performance event processing as described below.

On the other hand, in the case of the normal performance mode at step 210, the processing proceeds to step 230 to execute normal event processing (that is, musical tone generation processing as a normal electronic instrument). As to the normal event processing, it does not directly relate to the present invention, and the description thereof is thus omitted.

Figure 8:
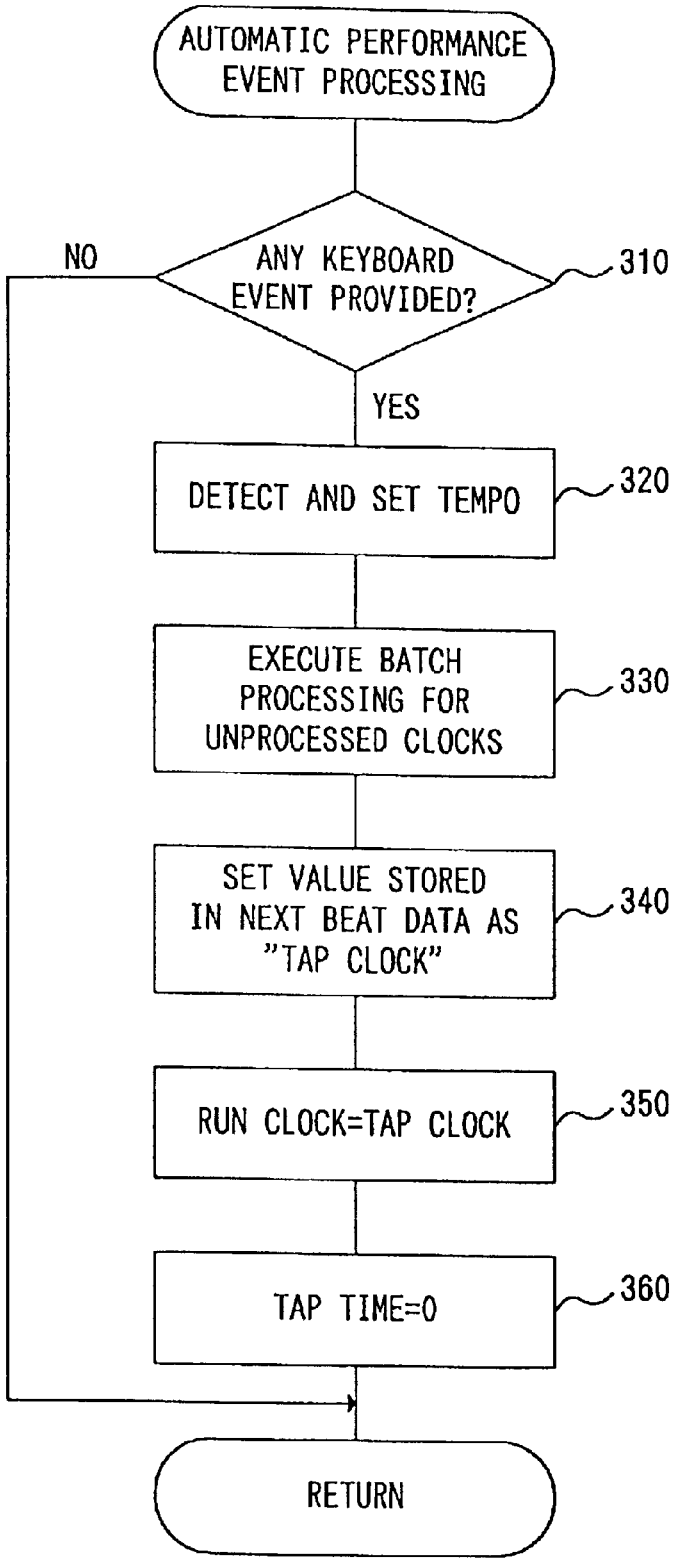
FIG. 8 is a flow chart showing automatic performance event processing executed in the electronic instrument according to the first embodiment.

At step 220, the automatic performance event processing is executed as shown in FIG. 8.

In the automatic performance event processing, it is first determined, at step 310, whether or not any keyboard event (or external event) has been provided. Such determination is achieved in the following manner. First of all, the keyboard 108 is scanned by the key switch circuit 101, thereby importing data representing the pressed state of each key (hereinafter referred to as new key data) as a bit array corresponding to each key.

Then, data previously read in and already stored in the RAM 104 (hereinafter referred to as old key data) are compared with the new key data to check whether or not there are any different bits existing between the old and new key data, thereby creating a keyboard event map in which the different bits are turned on. The presence of any keyboard event is thus determined by referring to this keyboard event map. More specifically, if there is existing even only one bit that is on in the keyboard event map, it is determined that any keyboard event has been provided.

In cases where the presence of any keyboard event is determined by reference to the keyboard event map created in the aforementioned manner, the processing proceeds to step 320. On the other hand, in cases where the presence of no keyboard event is determined, the processing returns from the automatic performance event processing routines to the main routines.

At step 320, the tempo of the automatic musical performance (i.e., "new tempo") is determined by means of the following formula:

$$(\text{New Tempo})=(\text{Old Tempo})\times(\text{Tap Clock})/(\text{Tap Time})$$

In this formula, the "old tempo" is a tempo determined in the previous automatic performance event processing. The "tap clock" is a numerical value (i.e., 96 or 48) previously recorded in the automatic performance data as an assumed value of the number of times (i.e., clock number) the tempo timer 115 sends the signals during one section of the automatic performance data. The "tap time" is an actually measured value of the clock number between provisions of the previous keyboard event and the current keyboard event, which is counted up in automatic performance clock processing as described below.

The "new tempo" thus determined is set as the tempo (i.e., interruptive interval) of the tempo timer 115 until provision of the next keyboard event. Then, the tempo of the tempo timer 115 becomes the tempo of the automatic musical performance, as described below, until provision of the next keyboard event.

After step 320, the processing proceeds to step 330, at which batch processing for unprocessed clocks is carried out.

More specifically, when an (n+1)th keyboard event is provided during execution of the automatic musical performance within an nth section of the automatic performance data, the automatic musical performance is progressed at a burst to the beginning of an (n+1)th section, and then, from the beginning of the (n+1)th section, the automatic musical performance is restarted with the tempo detected and set at step 320.

Such processing at step 330 realizes a function in which, each time a keyboard event is provided, a section of the automatic performance data corresponding to the provided keyboard event is automatically performed.

After step 330, the processing proceeds to step 340, at which a value stored in the next beat data is set as the "tap clock."

At step 350, the "tap clock" set at step 340 is set as a "run clock." The "run clock" is, as described in detail below, a value for prescribing the progress of the processing for the automatic musical performance.

At step 360, the "tap time" is set to be zero.

Figure 9:
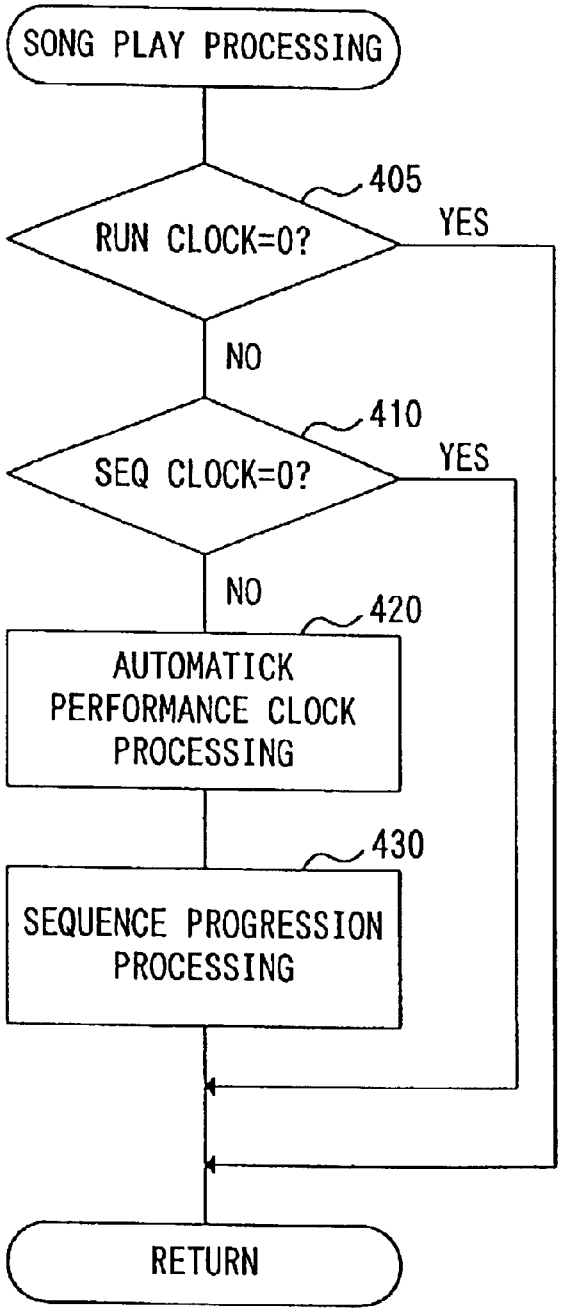
FIG. 9 is a flow chart showing song play processing executed in the electronic instrument according to the first embodiment.

Once the keyboard event processing is ended, song play processing (step 40 in FIG. 5) is next executed. The details of the song play processing are shown in FIG. 9.

At step 405, it is determined whether or not the "run clock" is zero. If the "run clock" is determined not to be zero, the processing proceeds to step 410. On the other hand, if the "run clock" is determined to be zero, the processing returns from the song play processing routines to the main routines.

As mentioned above, the value of the "tap clock" is set as the "run clock" in the automatic performance event processing, and as described below, subtraction is made therefrom depending on the tempo of the tempo timer 115 in the automatic performance clock processing.

Figure 10:
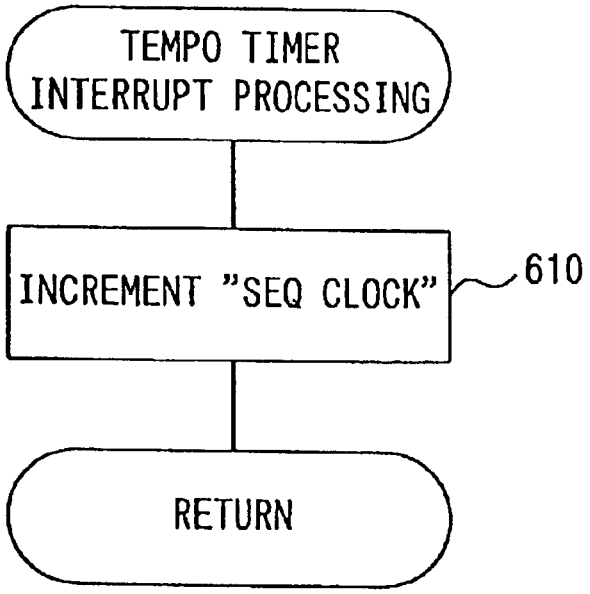
FIG. 10 is a flow chart showing tempo timer interrupt processing executed in the electronic instrument according to the first embodiment.

At step 410, it is determined whether or not a "seq clock" is zero. The "seq clock" is, as shown in FIG. 10, a numerical value incremented by the interrupting signals transmitted from the tempo timer 115 and reset to be zero after the song play processing is ended. Accordingly, the "seq clock" represents the clock number from the immediately preceding song play processing. Also, the tempo at which the tempo timer 115 transmits the interrupting signals is the tempo set in the automatic performance event processing as mentioned above.

In cases where it is determined, at step 410, that the "seq clock" is zero, it is considered that timing for generation of musical tones for the automatic musical performance has not yet been reached, and the processing thus returns from the song play processing routines to the main routines.

Figure 11:
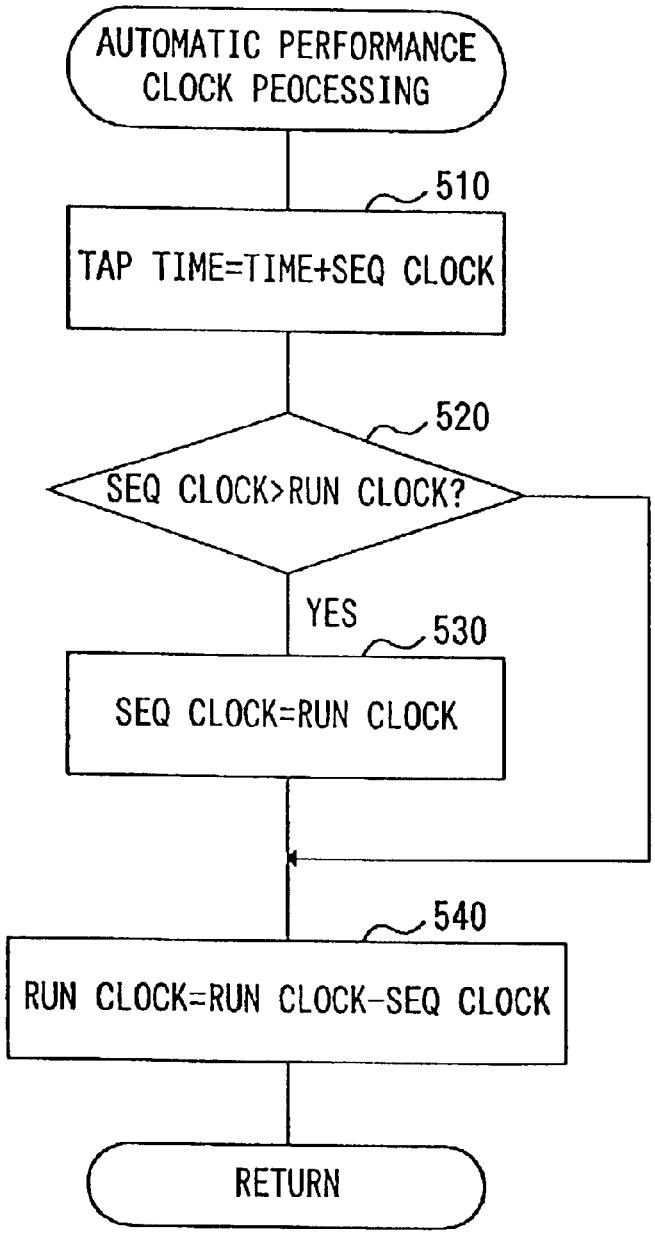
FIG. 11 is a flow chart showing automatic performance clock processing executed in the electronic instrument according to the first embodiment.

On the other hand, in cases where it is determined, at step 410, that the "seq clock" is not zero, the processing proceeds to step 420, at which the automatic performance clock processing is executed. The details of the automatic performance clock processing are shown in FIG. 11.

At step 510 in the automatic performance clock processing, the value of the "seq clock" is added to the value of the "tap time." Accordingly, the "tap time" is also incremented, just like the "seq clock," by each interrupting signal transmitted from the tempo timer 115.

At step 520, it is determined whether or not the "seq clock" is larger than the "run clock."

If it is determined that the "seq clock" is not larger than the "run clock," the processing proceeds to step 540. On the other hand, if it is determined, at step 520, that the "seq clock" is larger than the "run clock," the processing proceeds to step 530, where the value of the "run clock" is set as the value of the "seq clock," and then, the processing proceeds to step 540.

At step 540, the value of the "seq clock" is subtracted from the value of the "run clock." Then, the processing returns from the automatic performance clock processing routines to the main routines.

Subsequently, the processing again returns to the song play processing routines (in FIG. 9). At step 430, sequence progression processing is carried out, and more particularly, among the note data on the basis of which musical tones have not yet been generated, those within a certain range are sequentially read out and sent to the musical tone generator 107.

By means of the musical tone generator 107, the pitch and duration of musical tones to be generated are determined in accordance with the key number K and the gate time G, respectively, included in the note data. The musical tone generator 107 also determines the volume of the musical tones to be generated in accordance with the velocity V included in the note data and velocity at which keys of the keyboard are pressed on. In this manner, musical tones are generated by the musical tone generator 107.

Figure 12:
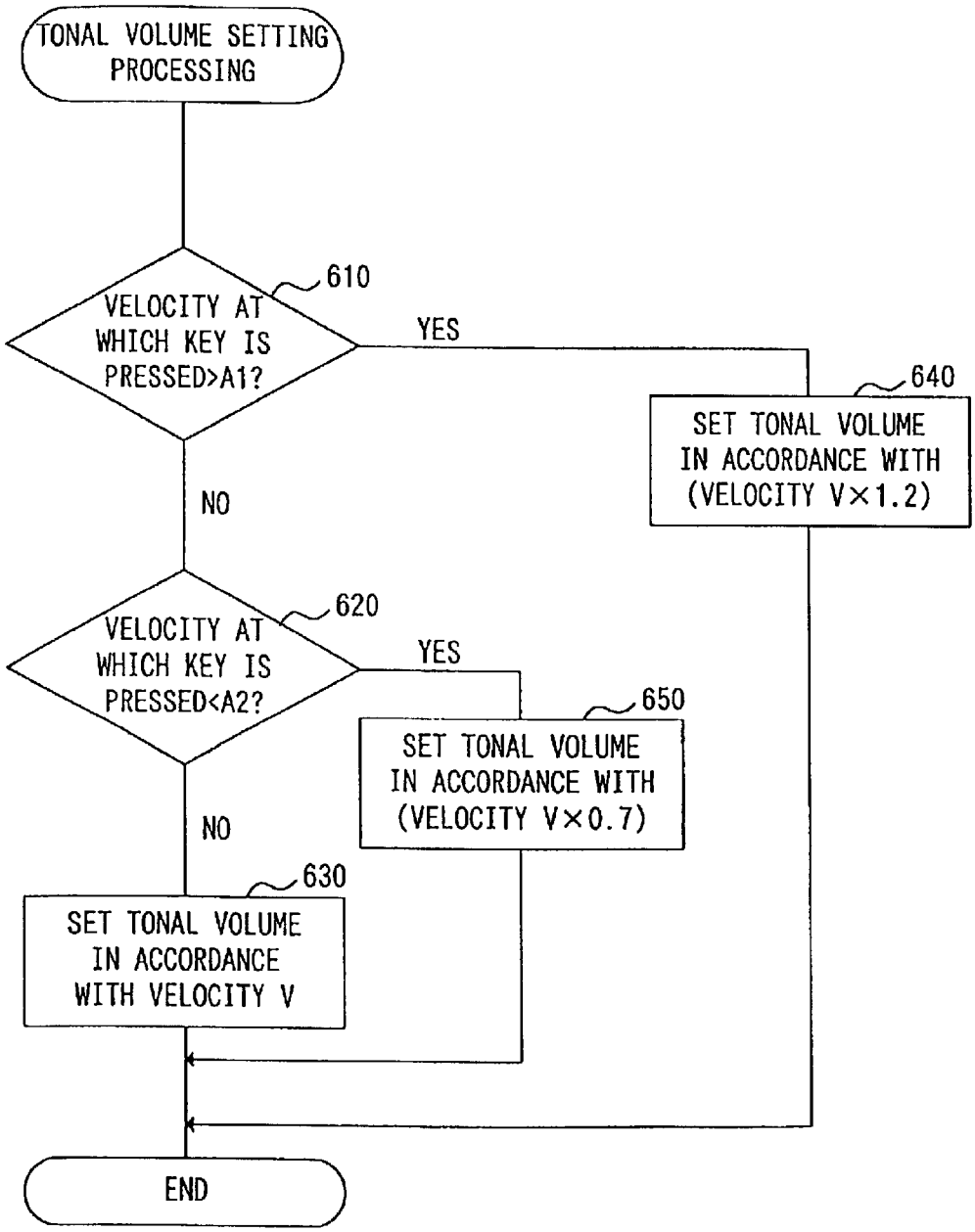
FIG. 12 is a flow chart showing tonal volume setting processing executed in the electronic instrument according to the first embodiment.

Specific processing relating to setting of the tonal volume is as shown in FIG. 12.

At step 610, it is determined whether or not velocity at which a key of the keyboard is pressed on is larger than a prescribed value A1. If it is determined that the velocity is not larger than the prescribed value A1, the processing proceeds to step 620. On the other hand, if it is determined that the velocity is larger than the prescribed value A1, the processing proceeds to step 640.

At step 620, it is determined whether or not the velocity at which the key is pressed on is smaller than a prescribed value A2. If it is determined that the velocity is not smaller than the prescribed value A2, the processing proceeds to step 630, while if it is determined that the velocity is smaller than the prescribed value A2, the processing proceeds to step 650. Here, the prescribed value A1 is larger than the prescribed value A2.

At step 630, the volume of musical tones to be generated on the basis of the note data within the section corresponding to the provided keyboard event is set in accordance with the velocity V included in the respective pieces of note data.

If the determination is "yes" at step 610, the volume of musical tones to be generated based on the note data within the section corresponding to the provided keyboard event is set, at step 640, in accordance with a value which is one point two (1.2) times the velocity V included in the respective pieces of note data.

Furthermore, if the determination is "yes" at step 620, the volume of musical tones to be generated based on the note data within the section corresponding to the provided keyboard event is set, at step 650, in accordance with a value which is zero point seven (0.7) time the velocity V included in the respective pieces of note data.

By such processing from step 610 to step 650, a user can change the tonal volume with respect to each section at the time of execution of the automatic musical performance, by changing strength at which keys of the keyboard are pressed on.

After step 430, the processing returns from the song play processing routines to the main routines (in FIG. 5).

Among the main routines, MIDI reception processing (step 50) is to execute musical tone generation processing, mute processing, or any other processing on the basis of data inputted from an external device (not shown) connected, via a MIDI terminal, to the electronic instrument. However, this processing does not directly relate to the present invention, and the description thereof is thus omitted.

The remaining processing (step 60) among the main routines includes tone color selection processing, volume setting processing and others, which do not directly relate to the present invention and the description thereof is thus omitted as well.

Now, by means of the electronic instrument 100 according to this first embodiment, the following effects can be achieved.

Firstly, in the electronic instrument 100, the automatic performance data is segmented into each section equivalent to one beat, and each time a keyboard event is provided, the automatic musical performance is progressed by the section.

Consequently, it is only necessary for a user to provide keyboard events at intervals of one beat, and it is unnecessary for him/her to provide keyboard events with respect to all pieces of note data.

As a result, the user can easily carry out an automatic musical performance.

Secondly, in the electronic instrument 100, the tempo of the automatic musical performance is set on the basis of intervals between the keyboard events. Consequently, the user can freely change the tempo of the automatic musical performance by varying such intervals between the keyboard events.

Thirdly, in the electronic instrument 100, the tempo of the automatic musical performance is changed with respect to each beat in accordance with the tempo at which the keyboard events are provided. Consequently, compared to cases where the automatic musical performance is progressed at a fixed tempo, undesired situations are less likely to occur in which there are some note data left without being changed into musical tones when the next keyboard event is provided or, on the contrary, in which there is an unnatural pause inserted after all note data within a certain section have been changed into musical tones and before the next keyboard event is provided.

Second Embodiment

The composition of an electronic instrument according to a second embodiment of the invention is basically the same as that of the electronic instrument 100 according to the first embodiment as described above, except for a partial difference in composition of the automatic performance data. The composition of the electronic instrument according to the second embodiment corresponding to that of the electronic instrument 100 according to the first embodiment will not be repeated hereinafter.

As shown in FIG. 13, automatic performance data in an electronic instrument 200 according to this second embodiment are segmented into sections, each of such sections comprising a piece of note data for a melody located at the beginning of each section and note data for accompaniments following the melody.

Accordingly, the length of each section is not equal, and thus, as the "tap clock" which is, as mentioned above, an assumed value of the clock number in a section, a different value is calculated for each section.

Also, each piece of note data for a melody and for accompaniments includes the key number K, step time S, gate time G, and velocity V.

Now, the outline of the operation of the electronic instrument 200 will be described.

In the electronic instrument 200, an automatic musical performance is progressed by the section of the automatic performance data in response to keyboard events, in which respect the electronic instrument 200 is the same as the electronic instrument 100 according to the first embodiment.

Also, the tempo of the automatic musical performance until provision of the next keyboard event is reset each time a keyboard event is provided, in which respect the electronic instrument 200 is also the same as the electronic instrument 100.

However, in the electronic instrument 200, the sections of the automatic performance data are based on the piece of note data for a melody as mentioned above, and accordingly, each time a keyboard event is provided, the automatic musical performance is progressed by the piece of note data for a melody.

More specifically, in response to a first keyboard event, the automatic musical performance is started with the note data for a melody located at the beginning of a first section, and then progressed to the note data for accompaniments following the melody. In the same manner, in response to an nth keyboard event, the automatic musical performance is progressed from the note data for a melody located at the beginning of an nth section to the note data for accompaniments following the melody.

The specific operation of the electronic instrument 200 at the time of execution of the automatic musical performance is basically the same as that of the electronic instrument 100 according to the first embodiment.

As mentioned above, however, in the electronic instrument 200, the sections of the automatic performance data are based on each piece of note data for a melody, and the length of each section (or "tap clock") is not equal.

Consequently, in the automatic performance data, a different value is calculated for each section as the "tap clock."

Figure 14:
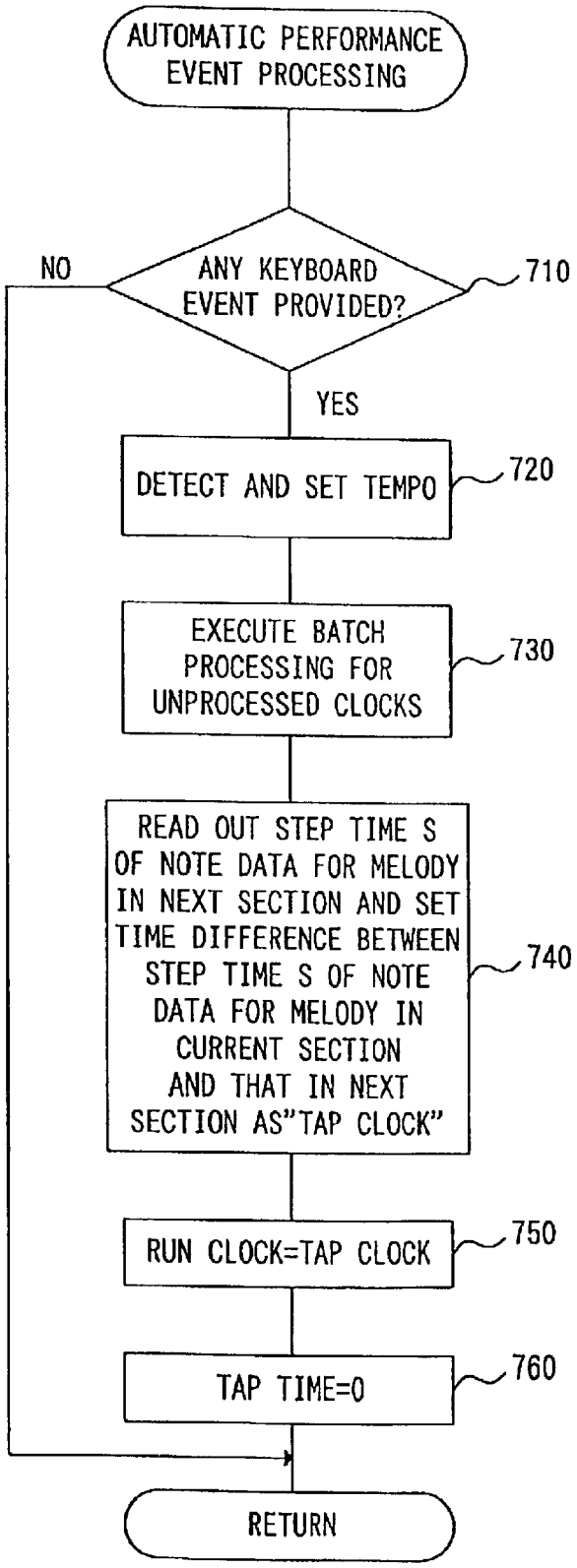
FIG. 14 is a flow chart showing automatic performance event processing executed in the electronic instrument according to the second embodiment.

Specifically, in automatic performance event processing of the electronic instrument 200, as shown in FIG. 14, at step 740, a difference between the step time S of the note data for a melody in the current section and that of the note data for a melody in the next section is determined to be the "tap clock" for the current section.

By means of the electronic instrument 200 according to this second embodiment, the following effects can be achieved.

Firstly, in the electronic instrument 200, each time a keyboard event is provided, musical tones for a melody and accompaniments following the melody are generated.

Accordingly, it is only necessary for a user to provide keyboard events in accordance with the timing of the melody, and it is not necessary for him/her to provide keyboard events in accordance with the timing of the accompaniments.

As a result, the user can easily carry out an automatic musical performance.

Secondly, in the electronic instrument 200, the tempo of the automatic musical performance can be freely changed by varying intervals between the keyboard events, in the same manner as in the electronic instrument 100 according to the first embodiment.

Thirdly, in the electronic instrument 200, the tempo of the automatic musical performance is set in accordance with the tempo at which the keyboard events are provided, just like in the electronic instrument 100 according to the first embodiment. Consequently, compared to cases where the automatic musical performance is progressed at a fixed tempo, undesired situations are less likely to occur in which there are some note data left without being changed into musical tones when the next keyboard event is provided or, on the contrary, in which there is an unnatural pause inserted after all note data within a certain section have been changed into musical tones and before the next keyboard event is provided.

Third Embodiment

The composition and operation of an electronic instrument according to a third embodiment of the invention is basically the same as those of the electronic instrument 100 according to the first embodiment as described above, except for a difference in the setting method for the tempo of the automatic musical performance. The composition and the operation corresponding to those of the electronic instrument 100 according to the first embodiment will not be repeated hereinafter.

In an electronic instrument 300 according to this third embodiment, in detection of the tempo (step 320) in the automatic performance event processing (in FIG. 8), the tempo of the automatic musical performance (i.e., "new tempo") is determined by means of the following formula:

$$(\text{New Tempo})=\alpha(\text{Old Tempo})+(1\alpha)F$$

In this formula, the "old tempo" is a tempo set by means of this formula when, for example, the previous external event is provided. Also, in the setting of a first tempo immediately after the automatic musical performance is started, for example, a value previously recorded in the song data may be used.

"$\alpha$" is a numerical value larger than zero and smaller than one, which may be, for example, 0.5. If the value of "$\alpha$" is larger, a contribution of "F" to the "new tempo" becomes smaller, thereby making a change of the "new tempo" gradual. On the contrary, if the value of "$\alpha$" is smaller, it is possible to immediately change the "new tempo" in accordance with the change of intervals between the external events.

By means of the electronic instrument 300 according to this third embodiment, the following effects can be achieved.

Firstly, a user can easily carry out an automatic musical performance with the electronic instrument 300, since it is only necessary for him/her to provide keyboard events at intervals of one beat, just like in the electronic instrument 100 according to the first embodiment.

Secondly, in the electronic instrument 300, the tempo of the automatic musical performance can be freely changed by changing the tempo of provision of the keyboard events, like in the electronic instrument 100 according to the first embodiment. Consequently, compared to cases where the automatic musical performance is progressed at a fixed tempo, undesired situations are less likely to occur in which there are some note data left without being changed into musical tones when the next keyboard event is provided or, on the contrary, in which there is an unnatural pause inserted all note data within a certain section have been changed into musical tones and before the next keyboard event is provided.

The present invention is, of course, not restricted to the embodiments as described above, and may be practiced or embodied in still other ways without departing from the subject matter thereof.

What is claimed is:

1. An automatic musical performance instrument comprising:

an input device for communicating a first selected external input to the instrument;

a storage device for storing musical data segmented into individual portions of musical data and providing a tempo at which the individual portions of musical data is output;

a controller for matching the first selected external inputs with an individual portion of musical data;

an output device for audibly outputting the desired individual portion of musical data in response to the first selected external input; and wherein the tempo at which the desired individual portion of musical data is output is dependent upon a time interval between the first selected external input and a second external input to the instrument; and wherein the controller sets the time interval for the tempo according to a ratio between an initial time interval and a measured time interval measured between the first and second external inputs.

2. The automatic musical performance instrument according to claim 1, wherein the individual portion of musical data corresponding with the first selected external input is applied to a single beat of a measure.

3. The automatic musical performance instrument according to claim 2, wherein the individual portion of musical data contains at least one piece of note data which is audibly output by the output device in response to the first selected external input.

4. The automatic musical performance instrument according to claim 2, wherein the individual portion of musical data associated with the first selected external input includes accompaniment data correlated with the at least one piece of note data.

5. The automatic musical performance instrument according to claim 1, wherein the first time interval is an assumed time interval.

6. The automatic musical performance instrument according to claim 1, wherein the first time interval is a previously measured time interval.

7. The automatic musical performance instrument according to claim 1, wherein for each external input the controller provides a new tempo adjusted by the tempo multiplied by a ratio between the first time interval and the measured time interval.

8. The automatic musical performance instrument according to claim 1, wherein the storage device is further provided with a desired constant, $\alpha$, being a value between about 0 and 1 and for each external input the controller provides a new tempo adjusted by the constant a multiplied by the tempo and added to a value of $1-\alpha$ multiplied by the measured time interval.

9. The automatic musical performance instrument according to claim 1, wherein the storage device is further provided with a constant velocity value and the controller is further provided with a measured velocity value from the external input and compares the measured velocity value with the constant velocity value to produce a corrected velocity value which is applied to the audible output.

10. The automatic musical performance instrument according to claim 9, wherein the measured velocity value is greater than the constant velocity value, the corrected velocity value is equal to about 1.2 multiplied by the constant velocity value, and wherein the measured velocity value is less than the constant velocity value, the corrected velocity value is equal to about 0.7 multiplied by the constant velocity value.

11. An automatic musical performance instrument comprising:

an input device for communicating a selected first external input to the instrument;

a storage device for storing musical data segmented into individual portions of musical data and providing a tempo and a constant velocity value at which the individual portions of musical data is output;

a controller for matching the first selected external inputs with a desired individual portion of musical data;

an output device for audibly outputting the desired individual portion of musical data in response to the first selected external input; and wherein the controller is provided with a measured velocity value from the external input and compares the measured velocity value with the constant velocity value to produce a corrected velocity value which is applied to the audible output, and the tempo at which the desired individual portion of musical data is audibly output is dependent upon a time interval between the selected first external input and a second external input to the instrument.

* * * * *